US007297831B2

(12) United States Patent
Lee et al.

(10) Patent No.: US 7,297,831 B2
(45) Date of Patent: Nov. 20, 2007

(54) PROCESS OF PREPARING AROMATIC HYDROCARBONS AND LIQUEFIED PETROLEUM GAS FROM HYDROCARBON MIXTURE

(75) Inventors: Jong Hyung Lee, Daejeon (KR); Seung Hoon Oh, Daejeon (KR); Kyoung Hak Sung, Daejeon (KR); Sun Choi, Daejeon (KR); Yong Seung Kim, Daejeon (KR); Byeung Soo Lim, Daejeon (KR)

(73) Assignee: SK Corporation, Seoul (KR)

( * ) Notice: Subject to any disclaimer, the term of this patent is extended or adjusted under 35 U.S.C. 154(b) by 0 days.

(21) Appl. No.: 11/557,574

(22) Filed: Nov. 8, 2006

(65) Prior Publication Data

US 2007/0112237 A1 May 17, 2007

(30) Foreign Application Priority Data

Nov. 14, 2005 (KR) ..... 10-2005-0108595

(51) Int. Cl.

| | |
|---|---|
| ***C07C 15/12*** | (2006.01) |
| ***C07C 4/18*** | (2006.01) |
| ***C10G 35/06*** | (2006.01) |
| ***C01G 47/00*** | (2006.01) |

(52) U.S. Cl. ..... 585/489; 585/475; 208/137; 208/138; 208/111.2; 208/111.35

(58) Field of Classification Search ..... 585/489, 585/475, 648, 653; 208/137, 138, 111.2, 208/111.35

See application file for complete search history.

(56) References Cited

U.S. PATENT DOCUMENTS

| | | | | |
|---|---|---|---|---|
| 2,849,290 | A | 8/1958 | Faust et al. | |
| 3,729,409 | A | 4/1973 | Chen | |
| 3,950,241 | A | 4/1976 | Bonacci et al. | |
| 4,058,454 | A | 11/1977 | Asselin | |
| 5,865,986 | A | 2/1999 | Buchanan et al. | |
| 6,001,241 | A | 12/1999 | Gosling et al. | |
| 6,635,792 | B2 * | 10/2003 | Choi et al. | 585/489 |

* cited by examiner

*Primary Examiner*—Thuan Dinh Dang
(74) *Attorney, Agent, or Firm*—Darby & Darby

(57) ABSTRACT

Disclosed is a process of preparing aromatic hydrocarbons and liquefied petroleum gas (LPG) from a hydrocarbon mixture, in which a non-aromatic compound in the hydrocarbon feedstock mixture is converted into a gaseous material having a large amount of LPG through hydrocracking, and an aromatic compound therein is converted into an oil component having large amounts of benzene, toluene, and xylene (BTX) through dealkylation and transalkylation, in the presence of a catalyst obtained by supporting platinum/bismuth onto a mixture support having zeolite and an inorganic binder. The gaseous product is separated into LPG and a mixture of methane and ethane depending on differences in boiling point through distillation, while the liquid product is separated into benzene, toluene, xylene, and C9+ aromatic compounds depending on differences in boiling point through distillation.

16 Claims, 1 Drawing Sheet

PROCESS OF PREPARING AROMATIC HYDROCARBONS AND LIQUEFIED PETROLEUM GAS FROM HYDROCARBON MIXTURE

INCORPORATION BY REFERENCE

The present application claims priority under 35 U.S.C. §119 to Korean Patent Application No. 10-2005-0108595 filed on Nov. 14, 2005. The content of the application is incorporated herein by reference in its entirety.

TECHNICAL FIELD

The present invention relates, in general, to a process of preparing aromatic hydrocarbons and liquefied petroleum gas (LPG) from a hydrocarbon mixture. More particularly, the present invention relates to a process of converting a non-aromatic compound in a hydrocarbon feedstock mixture into a gaseous material which is abundant in LPG through hydrocracking, and converting an aromatic compound therein into an oil component including benzene, toluene, xylene, etc., through dealkylation and/or transalkylation, in the presence of a platinum/bismuth supported zeolite-based catalyst.

BACKGROUND ART

Generally, aromatic hydrocarbons are obtained by separating feedstocks, having large amounts of aromatic compounds, such as reformate produced through a catalytic reforming process and pyrolysis gasoline produced through a naphtha cracking process, from non-aromatic hydrocarbons through solvent extraction. The aromatic hydrocarbon mixture thus separated is typically separated into benzene, toluene, xylene and C9+ aromatic compounds depending on differences in boiling point, and thus is used as a fundamental material in the field of the petrochemical industry. On the other hand, the non-aromatic hydrocarbons are used as raw material or fuel of the naphtha cracking process.

In this regard, U.S. Pat. No. 4,058,454 discloses a solvent extraction process for separating and recovering polar hydrocarbons from a hydrocarbon mixture including polar hydrocarbons and nonpolar hydrocarbons. In the solvent extraction process known in the art including the above patent, the nature in which the aromatic hydrocarbons are polar in common is used. That is, when a solvent, capable of dissolving a polar material, such as sulfolane, contacts the hydrocarbon mixture, polar aromatic hydrocarbons are selectively dissolved and thus separated from the nonpolar non-aromatic hydrocarbons. This method is advantageous because a highly pure aromatic hydrocarbon mixture can be obtained, but suffers because additional solvent extraction equipment is required and the solvent should be continuously supplied during the process. Thus, the development of methods of separately obtaining aromatic hydrocarbons and non-aromatic hydrocarbons from feedstock even without an additional solvent extraction process has been required.

In order to separate the aromatic compound from the non-aromatic compound, attempts have been made using a reaction system other than the solvent extraction process. The non-aromatic compound, mixed with the aromatic compound, is converted into gaseous hydrocarbon through hydrocracking in the presence of a catalyst, and the aromatic mixture and the non-aromatic mixture are separated from each other using a gas-liquid separator positioned at an end of a reactor. Such a concept has been developed in U.S. Pat. No. 3,729,409. Further, U.S. Pat. Nos. 3,729,409, 2,849,290, and 3,950,241, aim to be a method of producing a high-quality gasoline component by converting a linear hydrocarbon component mixed with an aromatic compound into a gaseous component through hydrocracking using ZSM-5 zeolite to increase the amount of aromatic component in a liquid component. Such a concept has been developed for a process of increasing production of benzene/toluene through a reforming process by filling parts of continuous reactors for a reforming process with a zeolite catalyst, as disclosed in U.S. Pat. No. 5,865,986. In addition, U.S. Pat. No. 6,001,241 discloses a method of increasing a yield of aromatic component by filling parts of reactors for a reforming process with a zeolite catalyst having similar reaction properties. However, the above concept has not yet been applied as an independent process separate from a reforming process for producing an aromatic component. In the case where the feedstock including reformate and pyrolysis gasoline is treated as an independent process, LPG may be further produced along with the aromatic component. In particular, in regions where almost all of the LPGs depend on importation, as in Korea, if LPG were produced as a by-product, it may substitute for a considerable amount of imported LPG.

However, the commercially available application of the above concept is under many restrictions. In particular, the deposition of coke on a catalyst may be caused by a side reaction, thus shortening the lifetime of the catalyst. Hence, techniques for overcoming this problem are required. The deposition of coke may be suppressed by supporting a metal component having high hydrogenation activity, such as metals corresponding to a Group VIII of the periodic table, onto a zeolite catalyst. However, the high hydrogenation activity of the metal component entails a side reaction converting the aromatic compound into the non-aromatic compound through a hydrogenation reaction. Thus, there is need for controlling the hydrogenation function by the metal component. In U.S. Pat. No. 5,865,986, the content in which metal activity is controlled using a sulfur compound is incorporated. Accordingly, research into methods of controlling the hydrogenation activity of a metal of a Group VIII by introducing another metal component has been continuously conducted.

DISCLOSURE OF THE INVENTION

Leading to the present invention, intensive research into methods of preparing aromatic hydrocarbons and LPG from a hydrocarbon mixture, conducted by the present inventors, led to the development of a method of simultaneously obtaining a highly pure aromatic hydrocarbon mixture and LPG by converting a hydrocarbon feedstock including reformate, pyrolysis gasoline, etc., into a liquid aromatic hydrocarbon mixture and a gaseous non-aromatic hydrocarbon mixture in the presence of a zeolite-based catalyst having platinum and bismuth, even without an additional solvent extraction process.

Therefore, it is an object of the present invention to provide a method of obtaining a highly pure aromatic hydrocarbon mixture and LPG from a hydrocarbon feedstock by replacing a solvent extraction process with a reaction process.

It is another object of the present invention to provide a method of converting non-aromatic hydrocarbon compounds in a hydrocarbon feedstock into a gaseous product having a large amount of LPG through hydrocracking in the presence of a catalyst.

According to an embodiment of the present invention, in order to achieve the above and other objects, a process of preparing aromatic hydrocarbons and LPG from a hydrocarbon mixture is provided, the process comprising the following steps of (a) introducing a hydrocarbon feedstock mixture and hydrogen into at least one reaction zone; (b) converting the hydrocarbon feedstock mixture in the presence of a catalyst to (i) a non-aromatic hydrocarbon compound which is abundant in LPG through hydrocracking and to (ii) an aromatic hydrocarbon compound which is abundant in benzene, toluene and xylene (BTX) through dealkylation/transalkylation within the reaction zone; and (c) recovering the LPG and aromatic hydrocarbon compound, respectively from the reaction products of step (b) through gas-liquid separation and distillation, wherein the catalyst is prepared by supporting 0.01~0.5 parts by weight of platinum (Pt) and 0.01~3.0 parts by weight of bismuth (Bi) onto 100 parts by weight of a mixture support comprising 10~95 wt % of zeolite having a molar ratio of silica/alumina of 200 or less, selected from the group consisting of mordenite, β-zeolite, ZSM-5 zeolite and combinations thereof, and 5~90 wt % of an inorganic binder.

The process of the present invention may further comprise separating the aromatic hydrocarbon compound recovered in step (c) into benzene, toluene, xylene and C9+ aromatic compounds, respectively.

Preferably, in step (a), the molar ratio of hydrogen and hydrocarbon feedstock mixture is 0.5~10, and the hydrocarbon feedstock mixture, which is introduced into the reaction zone, has a weight hourly space velocity of 0.5~10 $hr^{-1}$.

Preferably, the step (b) is conducted at 250~600° C. under a pressure of 5~50 atm.

The hydrocarbon feedstock mixture may be selected from the group consisting of reformate, pyrolysis gasoline, a C9+ aromatic compound-containing mixture, naphtha, and combinations thereof.

Further, the mixture support preferably has an average pore diameter of 50~200 Å, a pore volume of 0.1~1 cc, a specific surface area of 200~400 $m^2/g$ and an apparent bulk density of 0.4~1.0 cc/g.

The inorganic binder may be selected from the group consisting of bentonite, kaoline, clinoptilolite, montmorillonite, γ-alumina, silica, silica-alumina, and combinations thereof.

The catalyst may be prepared by mixing zeolite, the inorganic binder, platinum and bismuth; and molding the mixture.

According to an aspect of the present invention, the catalyst may be prepared by mixing zeolite and the inorganic binder, followed by molding the mixture; supporting bismuth onto the molded mixture support; and supporting platinum onto the bismuth-supported mixture support.

According to another aspect of the present invention, the catalyst may be prepared by mixing zeolite and the inorganic binder; supporting an admixture comprising platinum and bismuth onto the mixture support; and molding the supported mixture support.

According to a further aspect of the present invention, the catalyst may be prepared by supporting platinum onto zeolite; mixing the platinum-supported zeolite and the inorganic binder, followed by molding the mixture; and supporting bismuth onto the platinum-supported mixture support.

According to still a further aspect of the present invention, the catalyst may be prepared by mixing zeolite and the inorganic binder, followed by molding the mixture support, while supporting either platinum or bismuth onto the mixture support; and supporting the other metal, which is not supported in a previous step, onto the mixture support.

According to another embodiment of the present invention, a process of preparing aromatic hydrocarbons and LPG from a hydrocarbon mixture is provided, the process comprising steps of (a) feeding a hydrocarbon feedstock mixture and hydrogen into at least one reaction zone; (b) converting the hydrocarbon feedstock mixture in the presence of a catalyst to (i) a non-aromatic hydrocarbon compound which is abundant in LPG through hydrocracking and to (ii) an aromatic hydrocarbon compound which is abundant in BTX through dealkylation/transalkylation within the reaction zone; (c) separating the reaction products of step (b) into an overhead stream including hydrogen, methane, ethane and LPG, and a bottom stream including the aromatic hydrocarbon compound, and residual hydrogen and non-aromatic hydrocarbon compound, through gas-liquid separation; (d) recovering the LPG from the overhead stream; and (e) recovering the aromatic hydrocarbon compound from the bottom stream, wherein the catalyst is prepared by supporting 0.01~0.5 parts by weight of platinum (Pt) and 0.01~3.0 parts by weight of bismuth (Bi) onto 100 parts by weight of a mixture support comprising 10~95 wt % of zeolite having a molar ratio of silica/alumina of 200 or less, selected from the group consisting of mordenite, β-zeolite, ZSM-5 zeolite and combinations thereof, and 5~90 wt % of an inorganic binder.

According to a further embodiment of the present invention, a process of preparing aromatic hydrocarbons and LPG from a hydrocarbon mixture is provided, the process comprising the following steps of (a) introducing the hydrocarbon feedstock mixture and hydrogen into at least one reaction zone; (b) converting the hydrocarbon feedstock mixture in the presence of a catalyst to (i) a non-aromatic hydrocarbon compound which is abundant in LPG through hydrocracking and to (ii) an aromatic hydrocarbon compound which is abundant in BTX through dealkylation/transalkylation within the reaction zone; (c) separating the reaction products of step (b) into a first overhead stream including hydrogen, methane, ethane and LPG and a first bottom stream including the aromatic hydrocarbon compound, and residual hydrogen and non-aromatic hydrocarbon compound, through gas-liquid separation; (d) recovering the LPG from the first overhead stream; and (e) separating the first bottom stream into (i) a second overhead stream including the residual hydrogen and the non-aromatic hydrocarbon compound and (ii) a second bottom stream including the aromatic hydrocarbon compound, through distillation; and (f) recovering the LPG from the second overhead stream and recovering the aromatic hydrocarbon compound from the second bottom stream, wherein the catalyst is prepared by supporting 0.01~0.5 parts by weight of platinum (Pt) and 0.01~3.0 parts by weight of bismuth (Bi) onto 100 parts by weight of a mixture support comprising 10~95 wt % of zeolite having a molar ratio of silica/alumina of 200 or less, selected from the group consisting of mordenite, β-zeolite, ZSM-5 zeolite and combinations thereof, and 5~90 wt % of an inorganic binder.

BEST MODE FOR CARRYING OUT THE INVENTION

Figure 1:
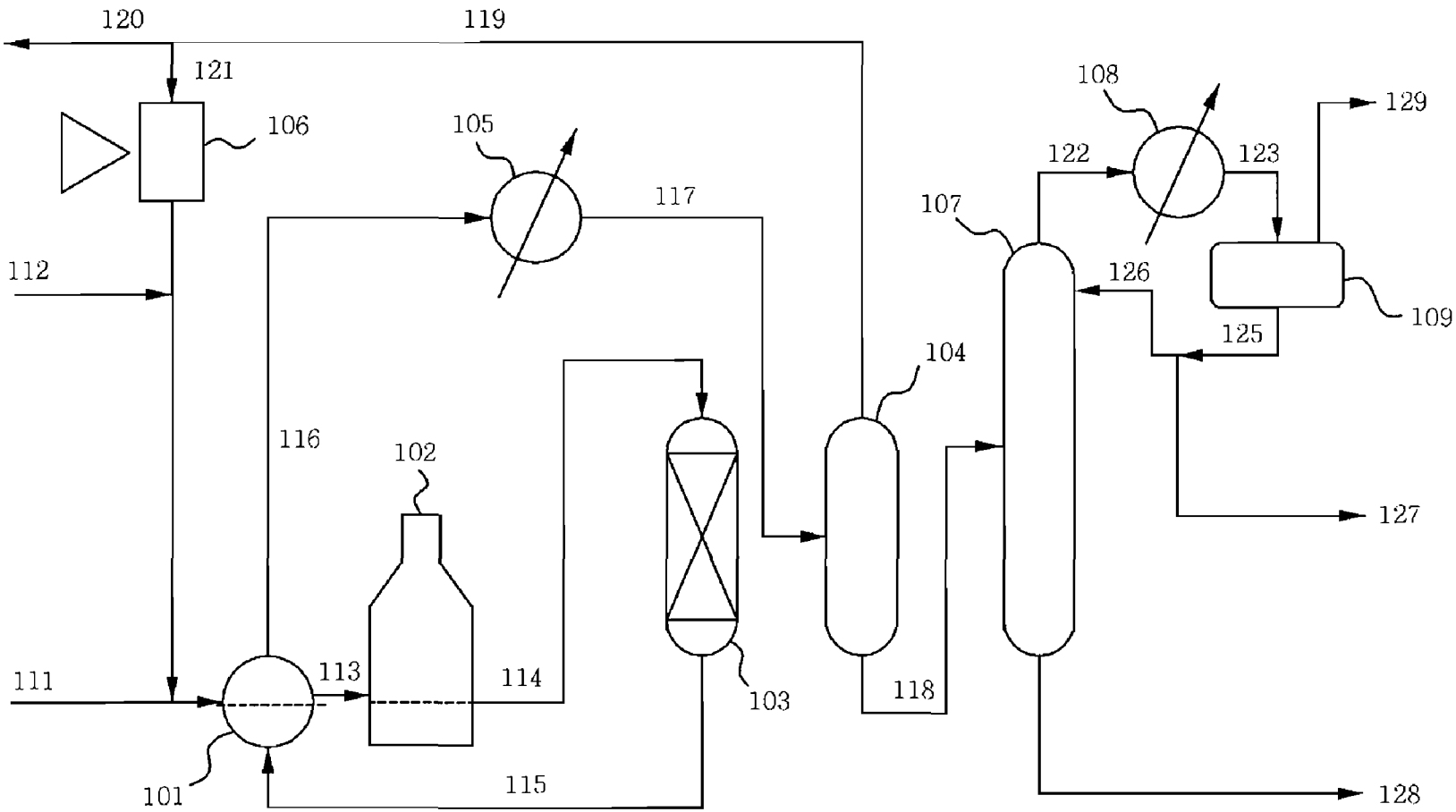
FIG. 1 illustrates a process of preparing aromatic hydrocarbons and LPG from a hydrocarbon feedstock mixture, according to the present invention.

Hereinafter, a detailed description will be given of the present invention, with reference to the appended drawing.

The present invention pertains to a process of preparing an aromatic hydrocarbon mixture and LPG from a hydrocarbon feedstock mixture.

Typical examples of the hydrocarbon feedstock mixture include reformate, pyrolysis gasoline, C9+ aromatic compound-containing mixtures, naphtha, and combinations thereof. In order to mainly recover an aromatic compound, a feedstock having a large amount of aromatic component, such as reformate or pyrolysis gasoline, is preferably used. In addition, in order to mainly produce LPG, a feedstock having a large amount of non-aromatic component, such as naphtha, is preferably used.

In the presence of a catalyst according to the present invention, hydrocracking of non-aromatic hydrocarbon compounds and dealkylation and transalkylation of aromatic compounds are simultaneously conducted. Through these reactions, main aromatic intermediates used in the field of the petrochemical industry, such as benzene, toluene, xylene, etc., are obtained, and the non-aromatic compound, such as LPG, is obtained as a by-product.

Among the reactions, in particular, the reaction for converting liquid non-aromatic compounds into a gaseous material through hydrocracking is most important. By the hydrocracking, a solvent extraction process of aromatic hydrocarbon compounds need not be conducted.

The dealkylation and transalkylation of aromatic compounds upgrade aromatic compounds. That is, C9+ aromatic compounds, which are mainly used as fuel oil, are converted into benzene, toluene, xylene, etc., through dealkylation, to improve the properties thereof. The transalkylation between the aromatic compounds upgrades the aromatic hydrocarbon mixture. For example, when benzene is reacted with a C9+ aromatic compound, toluene and xylene may be obtained.

It is possible to conduct the above reactions using a zeolite catalyst having a strong acid function. The zeolite catalyst is composed of pores, having a diameter (about 5~7 Å) suitable for passage and reaction of C5~C12 hydrocarbon molecules having a boiling point of 30~250° C. In addition, the catalyst is used in the form of a mixture support obtained by mixing at least one selected from the group consisting of mordenite, β-zeolite and ZSM-5 zeolite with an inorganic binder.

Upon the hydrocracking and dealkylation, olefins, such as ethylene, propylene, etc., may be produced. In this case, such olefins should be rapidly hydrogenated. The reason is that the produced olefin components are alkylated again to the aromatic compound, thus deteriorating the properties of the aromatic compound, forming liquid non-aromatic compounds through polymerization, or promoting formation of a coke that causes deactivation of the catalyst. Hence, a metal having a strong hydrogenation function must be incorporated into the zeolite. Generally, in the case of requiring the strong hydrogenation function, nickel (Ni), palladium (Pd), platinum (Pt), etc., which are metals belonging to a Group VIII in the periodic table, are used. Among the above-mentioned active metals, platinum has a strongest hydrogenation function. In the present invention, in order to inhibit the side reaction, platinum, as a very preferable metal, is incorporated into the catalyst.

Platinum, which is an active metal component having the strongest hydrogenation function, is advantageously used to realize rapid hydrogenation of olefins, required in the present invention, so as to improve the properties of a reaction product and reduce a deactivation rate of the catalyst. However, platinum causes a side reaction, such as conversion of the aromatic compound into a naphthene compound. That is, in addition to the hydrocracking, dealkylation and transalkylation, the aromatic compounds are converted into naphthene hydrocarbons through a hydrogenation, and the naphthene compounds are further hydrocracked and thus converted into gaseous paraffin hydrocarbons. This reaction is not preferable in terms of reduction in the residual amount of aromatic compound.

Hence, the activity of platinum should be appropriately controlled to cause the selective hydrogenation of olefins. In the present invention, bismuth (Bi) is thus used as a second metal component to confer the selective hydrogenation function on platinum.

Bismuth, which is introduced as a second metal component to control the activity of platinum, interacts with platinum to inhibit the side reaction caused by the strong hydrogenation function of platinum. In particular, when bismuth (Bi) is introduced as the second metal component, bismuth can exhibit increased inhibitory effects on the activity of platinum by virtue of stronger interactions with platinum, therefore more effectively controlling the function of platinum as an active metal, compared to when tin (Sn) or lead (Pb) is introduced. Thereby, bismuth can enhance the selective hydrogenation function of platinum, and thus inhibit the side reaction due to the excess hydrogenation function. In addition, while bismuth strongly interacts with platinum as an active metal, it minimizes a negative effect on the acid function of the mixture support, whereby the hydrocracking of the non-aromatic compound and the dealkylation and transalkylation of the aromatic compound can be efficiently conducted. In particular, hydrocracking performance of the non-aromatic component is improved, resulting in increased LPG yield and production of aromatic hydrocarbon compound having higher purity.

The mordenite, β-zeolite and ZSM-5 zeolite are prepared in the form of sodium upon initial synthesis, and are ion-exchanged with ammonium chloride or ammonium nitrate to obtain an ammonium form. The zeolite in an ammonium form is calcined, thereby obtaining zeolite in a hydrogen form. In the present invention, mordenite, β-zeolite and ZSM-5 zeolite, each of which is in an ammonium form or a hydrogen form, may be used. The mordenite, β-zeolite or ZSM-5 zeolite used in the present invention should have a molar ratio of silica/alumina of 200 or less. If the molar ratio of silica/alumina is larger than 200, the reaction activity is decreased and the temperature required for the reaction is undesirably drastically increased.

The zeolite is used in the form of a mixture support mixed with at least one inorganic binder. As such, the inorganic binder includes at least one selected from the group consisting of bentonite, kaoline, clinoptilolite, montmorillonite, γ-alumina, silica, and silica-alumina. Preferably, at least one selected from the group consisting of amorphous inorganic oxides, of γ-alumina, silica and silica-alumina is used, and more preferably, γ-alumina and/or silica are used.

When the inorganic binder is combined with zeolite, 10~95 wt % of zeolite and 5~90 wt % of the inorganic binder are mixed and molded into a cylindrical shape or a spherical shape.

As such, if the amount of zeolite is less than 10 wt %, the required reaction temperature is extremely increased. On the other hand, if the above amount exceeds 95 wt %, mechanical strength of the catalyst becomes poor.

In the case where the mixture support is molded into a cylindrical shape, it is preferably molded to have a diameter of 1~3 mm and a length of 5~30 mm. In addition, in the case where the mixture support is molded into a spherical shape, it is preferably molded to have a diameter of 1~5 mm.

The mixture support comprising zeolite and inorganic binder thus molded preferably has an average pore diameter of 50~200 Å, a pore volume of 0.1~1 cc, a specific surface area of 200~400 $m^2/g$ and an apparent bulk density of 0.4~1.0 cc/g.

In the present invention, zeolite and the inorganic binder may be mixed and molded, and then platinum/bismuth may be supported thereonto, thus preparing a final catalyst. Alternatively, metal components may be supported onto zeolite, and then mixed with the inorganic binder to mold a final catalyst.

In this way, when the metals are supported before or after the molding process, the introduction order of the two metals to be supported does not matter, so that any one metal thereof may be first introduced, or the two metals may be simultaneously introduced. Further, upon molding the support, the support may be mixed with an admixture comprising the two metals and then molded. Furthermore, upon molding, the support and any one of the two metals may be mixed and molded, and then the other metal may be supported thereonto, thus preparing a final catalyst.

Platinum, which is an active component of the catalyst, is preferably supported in an amount of 0.01~0.5 parts by weight relative to 100 parts by weight of the mixture support comprising zeolite and inorganic binder. As such, if the amount of platinum is less than 0.01 parts by weight relative to 100 parts by weight of the mixture support, the reaction rates of hydrocracking and dealkylation are lowered and thus the reaction temperature should be increased. Also, the deactivation rate of the catalyst is undesirably increased. On the other hand, if the amount of platinum exceeds 0.5 parts by weight relative to 100 parts by weight of the mixture support, the hydrocracking actively occurs and the aromatic compounds are considerably converted into naphthene compounds.

As a platinum supporting process, ion exchange, impregnation, and physical mixing may be applied. Such a supporting process may be easily conducted by those having general knowledge in the art. In the case where platinum is supported through ion exchange, an aqueous solution of ammonium chloroplatinate or dinitrodiaminoplatinum is used as a precursor. When platinum is introduced through impregnation, an aqueous solution of chloroplatinic acid or ammonium chloroplatinate is used as a precursor. Further, upon physical mixing, all of the aqueous precursor solutions mentioned above may be used.

In the reaction of the present invention, bismuth, which is a metal component supported along with platinum onto the mixture support, is preferably introduced in an amount of 0.01~3.0 parts by weight relative to 100 parts by weight of the mixture support comprising zeolite and inorganic binder. As such, when the amount of bismuth exceeds 3.0 parts by weight relative to 100 parts by weight of the mixture support, the function of platinum is extremely inhibited, and thus the reactivity is decreased and the deactivation rate of the catalyst is undesirably increased. On the other hand, if the above amount is less than 0.01 parts by weight, the strong hydrogenation function of platinum is not appropriately controlled, resulting in increased side reactions.

Bismuth is preferably supported onto the mixture support through an impregnation process or a mixing process. The precursor of bismuth is exemplified by bismuth (III) chloride, bismuth (III) oxychloride, bismuth nitrate, and bismuth acetate.

In the present invention, after the platinum/bismuth are supported onto the mixture support, the supported mixture support is preferably dried at 60~200° C. for a time period from 30 min to 12 hours in an air atmosphere. Then, the dried catalyst is preferably calcined at 300~600° C. for 1~12 hours in an air atmosphere or a nitrogen atmosphere.

As mentioned above, when the metal components such as platinum/bismuth are supported onto the mixture support comprising zeolite and inorganic binder, they may be sequentially introduced, regardless of the introduction order, or simultaneously introduced. As such, it is preferred that the metals be present in a state of being coupled with each other. In particular, when platinum is present in the state of being coupled with bismuth or is spaced apart from bismuth by an adjacent interval to the extent that they are electrically and chemically affected by each other, instead of being independently present in the catalyst, excellent catalyst performance may be expected.

That is, in the case where platinum is present alone, the above-mentioned side reactions may occur due to the high hydrogenation activity of platinum. However, in the case where bismuth is coupled with platinum or is spaced apart from platinum by a sufficiently adjacent interval, platinum exhibits the selective hydrogenation function thanks to the interaction of metals, which may be explained by an ensemble effect or a ligand effect, and thus optimum reaction performance may be expected.

FIG. 1 illustrates a process of preparing aromatic hydrocarbons and LPG from a hydrocarbon feedstock mixture, according to the present invention.

As shown in this drawing, the catalyst functions to cause the dealkylation, transalkylation and hydrocracking of the hydrocarbon feedstock mixture in at least one reactor in a reaction zone. The feedstock including an aromatic component and a non-aromatic component is mixed with hydrogen before being fed into the reactor.

As such, the molar ratio of hydrogen to feedstock is 0.5~10. When the molar ratio is less than 0.5, the deactivation of the catalyst is drastically progressed. On the other hand, if the molar ratio is larger than 10, the aromatic component is converted into a saturated cyclic hydrocarbon, thus decreasing the yield of aromatic component.

A hydrocarbon feedstock mixture stream 111 to be fed into the process is combined with a hydrogen stream 121 and a highly pure hydrogen stream 112. A hydrogen/feedstock 114 is fed into a reactor 103 at a weight hourly space velocity (WHSV) of 0.5~10 $hr^{-1}$ and thus reacted at 250~600° C. under pressure of 5~50 atm.

In order to increase the temperature of hydrogen/feedstock to the above reaction temperature, a heater 102 is additionally provided. Before being introduced into the heater 102, the hydrogen/feedstock is heat exchanged with a reaction product stream 115, which is discharged from the reactor 103 and circulated into a heat exchanger 101, after which it is fed into the heater 102 in a warm state 113.

In the reactor including the hydrogen/feedstock 114, the dealkylation and transalkylation of the aromatic component and the hydrocracking of the non-aromatic component are conducted under the above reaction conditions in the presence of the catalyst.

After completion of the reactions, the product 115 is present in a gas product at a relatively high temperature, which is then circulated into the heat exchanger 101 before being fed into a gas-liquid separator 104 to emit heat to the hydrogen/feedstock, and thereafter passed through a first cooler 105.

A product stream 117, passed through the first cooler 105, is fed into the gas-liquid separator 104 at about 30~50° C., to be separated into a gaseous component 119 and a liquid component 118. The gaseous component 119 is discharged from the gas-liquid separator 104 as a first overhead stream, and the liquid component 118 is discharged as a first bottom stream.

The gaseous component 119 comprises about 60~75 mol % of hydrogen and 25~40 mol % of hydrocarbons, in which the hydrocarbon component is composed of methane or ethane having low carbons, LPG, etc.

The hydrogen component is compressed in a compressor 106, combined with highly pure hydrogen 112 to control the purity of hydrogen, and then fed into the reaction zone along with the feedstock 111. In addition, the liquid component 118 is composed mainly of the aromatic components, with small amounts of residual hydrogen and light non-aromatic components.

Thus, the liquid component 118 is passed again through the separation and purification process, and is separated into a second overhead stream 122 comprising residual hydrogen and non-aromatic components and a second bottom stream 128 comprising aromatic components having 99% or more of purity, depending on differences in boiling point in a first distillation tower 107.

The second bottom stream 128 is recovered and then separated into benzene, toluene, xylene, C9+ aromatic compounds, etc., in a second distillation tower.

On the other hand, the second overhead stream 122 is cooled in a second cooler 108 and then recovered as a third overhead stream 129 as a gaseous mixture comprising residual hydrogen, methane and ethane using a gas-liquid separator 109 and thus may be used as fuel. A third bottom stream 126 in a liquid phase is circulated again into the distillation tower 107, part of which is recovered as a stream 127 including pentane, hexane, LPG components, etc. The components, circulated into the distillation tower, undergo the separation process along with the first bottom stream.

Thereby, the aromatic mixture may be separated to have purity of 99% or more, and the LPG component is obtained as a stream 120, in which hydrogen is removed from the first overhead stream 119, and a stream 127. As such, the stream 120 includes an amount corresponding to about 70~90% of the total LPG component.

A better understanding of the present invention may be obtained in light of the following examples which are set forth to illustrate, but are not to be construed to limit the present invention.

COMPARATIVE EXAMPLE 1

A mixture support, comprising ZSM-5 zeolite having a molar ratio of silica/alumina of 30 and γ-alumina as a binder, was mixed with an aqueous solution of $H_2PtCl_6$ and an aqueous solution of $SnCl_2$ such that the amount of ZSM-5 zeolite in the support with the exception of platinum and tin was 75 wt %. Platinum and tin were supported in amounts of 0.03 parts by weight and 0.5 parts by weight, respectively, relative to 100 parts by weight as the total amounts of ZSM-5 zeolite and the binder. The mixture support thus supported was molded to have a diameter of 2 mm and a length of 10 mm, dried at 120° C. for 3 hours, and then calcined at 500° C. for 3 hours, thus preparing a catalyst. Using the catalyst thus prepared, a hydrocarbon mixture was reacted. The reaction conditions and the reaction results are given in Table 1 below.

EXAMPLE 1

A mixture support, comprising ZSM-5 zeolite having a molar ratio of silica/alumina of 30 and γ-alumina as a binder, was mixed with an aqueous solution of $H_2PtCl_6$ and an aqueous solution of $Bi(NO_3)_3$ such that the amount of ZSM-5 zeolite in the support with the exception of platinum and bismuth was 75 wt %. Platinum and bismuth were supported in amounts of 0.03 parts by weight and 0.5 parts by weight, respectively, relative to 100 parts by weight as the total amounts of ZSM-5 zeolite and the binder. The mixture support thus supported was molded to have a diameter of 2 mm and a length of 10 mm, dried at 120° C. for 3 hours, and then calcined at 500° C. for 3 hours, thus preparing a catalyst. Using the catalyst thus prepared, a hydrocarbon mixture was reacted. The reaction conditions and the reaction results are given in Table 1 below.

EXAMPLE 2

A mixture support, comprising ZSM-5 zeolite having a molar ratio of silica/alumina of 30 and γ-alumina as a binder, was mixed with an aqueous solution of $H_2PtCl_6$ and an aqueous solution of $BiCl_3$ such that the amount of ZSM-5 zeolite in the support with the exception of platinum and bismuth was 75 wt %. Platinum and bismuth were supported in amounts of 0.03 parts by weight and 0.25 parts by weight, respectively, relative to 100 parts by weight as the total amounts of ZSM-5 zeolite and the binder. The mixture support thus supported was molded to have a diameter of 2 mm and a length of 10 mm, dried at 120° C. for 3 hours, and then calcined at 500° C. for 3 hours, thus preparing a catalyst. Using the catalyst thus prepared, a hydrocarbon mixture was reacted. The reaction conditions and the reaction results are given in Table 1 below.

EXAMPLE 3

A mixture support, comprising ZSM-5 zeolite having a molar ratio of silica/alumina of 30, mordenite having a molar ratio of silica/alumina of 20 and γ-alumina as a binder, was mixed with an aqueous solution of $H_2PtCl_6$ and an aqueous solution of $BiCl_3$ such that the amounts of ZSM-5 zeolite and mordenite in the support with the exception of platinum and bismuth were 50 wt % and 25 wt %, respectively. Platinum and bismuth were supported in amounts of 0.03 parts by weight and 0.25 parts by weight, respectively, relative to 100 parts by weight as the total amounts of ZSM-5 zeolite, mordenite and the binder. The mixture support thus supported was molded to have a diameter of 2 mm and a length of 10 mm, dried at 120° C. for 3 hours, and then calcined at 500° C. for 3 hours, thus preparing a catalyst. Using the catalyst thus prepared, a hydrocarbon mixture was reacted. The reaction conditions and the reaction results are given in Table 1 below.

EXAMPLE 4

A mixture support, comprising β-zeolite having a molar ratio of silica/alumina of 25 and γ-alumina as a binder, was mixed with an aqueous solution of $H_2PtCl_6$ and an aqueous solution of $BiCl_3$ such that the amount of β-zeolite in the support with the exception of platinum and bismuth was 75 wt %. Platinum and bismuth were supported in amounts of 0.03 parts by weight and 0.25 parts by weight, respectively, relative to 100 parts by weight as the total amounts of β-zeolite and the binder. The mixture support thus supported was molded to have a diameter of 2 mm and a length of 10 mm, dried at 120° C. for 3 hours, and then calcined at 500° C. for 3 hours, thus preparing a catalyst. Using the catalyst thus prepared, a hydrocarbon mixture was reacted. The reaction conditions and the reaction results are given in Table 1 below.

TABLE 1

| | | C. Ex. 1 | Ex. 1 | Ex. 2 | Ex. 3 | Ex. 4 |
|---|---|---|---|---|---|---|
| Reaction Conditions | | Temp.: 370° C., Pressure: 30 kg/cm$^2$, WHSV = 1.3 hr$^{-1}$, Molar ratio of $H_2$/hydrocarbon = 4 | | | | |
| Reactant (wt %) | | Non-aromatics: 39.01, C6~C8 Aromatics 45.60, C9+ Aromatics: 15.39 | | | | |
| Product (wt %) | C1-C2 | 9.81 | 9.47 | 10.18 | 8.24 | 7.87 |
| | LPG | 29.93 | 33.07 | 31.98 | 34.54 | 35.11 |
| | C5+ Non-Aromatics | 4.06 | 1.19 | 1.11 | 1.36 | 1.68 |
| | C6~C8 Aromatics | 49.64 | 49.52 | 48.12 | 47.32 | 45.83 |
| | C9+ Aromatics | 6.56 | 6.75 | 8.61 | 8.54 | 9.51 |

As is apparent from Table 1, hydrocracking performance of non-aromatic components according to the process of the present invention can be seen to be much improved, from a result of wt % of C5+ non-aromatic compounds in the product, compared to Comparative Example 1 using a conventional process. Through such improvements in hydrocracking performance, the non-aromatic component and aromatic component can be easily separated from each other even without additional solvent extraction equipment. In addition, the aromatic hydrocarbon compounds can be obtained at a higher purity. Further, according to the present invention, the LPG can be produced in an increased amount through conversion of the non-aromatic hydrocarbon compounds.

INDUSTRIAL APPLICABILITY

As previously described herein, the present invention provides a process of obtaining highly pure aromatic hydrocarbon mixtures and, as a by-product, non-aromatic hydrocarbon compounds including LPG, from a hydrocarbon feedstock mixture using a platinum/bismuth supported zeolite-based catalyst. According to the process of the present invention, only distillation towers are used without the need for additional solvent extraction equipment, whereby the non-aromatic components and aromatic components can be easily separated from each other. Further, the non-aromatic compounds, having low usability among the hydrocarbon feedstock mixture, are converted into LPG, thus exhibiting economic benefits. Particularly, the aromatic compounds, which are high value-added materials, can be obtained at higher purity.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A method of preparing aromatic hydrocarbons and liquefied petroleum gas (LPG) from a hydrocarbon mixture, comprising the following steps of:

(a) introducing a hydrocarbon feedstock mixture and hydrogen into at least one reaction zone;

(b) converting the hydrocarbon feedstock mixture in the presence of a catalyst to (i) a non-aromatic hydrocarbon compound which is abundant in LPG through hydrocracking and to (ii) an aromatic hydrocarbon compound which is abundant in benzene, toluene and xylene (BTX) through dealkylation/transalkylation within the reaction zone; and (c) recovering the LPG and aromatic hydrocarbon compound, respectively from the reaction products of step (b) through gas-liquid separation and distillation, wherein the catalyst is prepared by supporting 0.01~0.5 parts by weight of platinum (Pt) and 0.01~3.0 parts by weight of bismuth (Bi) onto 100 parts by weight of a mixture support, the mixture support including 10~95 wt % of zeolite having a molar ratio of silica/alumina of 200 or less, selected from the group consisting of mordenite, β-zeolite, ZSM-5 zeolite and combinations thereof, and 5~90 wt % of an inorganic binder.

2. The method according to claim 1, further comprising separating the aromatic hydrocarbon compound recovered in step (c) into benzene, toluene, xylene and C9+ aromatic compounds, respectively.

3. The method according to claim 1, wherein a molar ratio of hydrogen and hydrocarbon feedstock mixture in step (a) is 0.5~10, and the hydrocarbon feedstock mixture, which is introduced into the reaction zone, has a space velocity of 0.5~10 hr$^{-1}$.

4. The method according to claim 1, wherein step (b) is conducted at 250~600° C. under a pressure of 5~50 atm.

5. The method according to claim 1, wherein the hydrocarbon feedstock mixture is selected from the group consisting of reformate, pyrolysis gasoline, C9+ aromatic compound-containing mixtures, naphtha, and combinations thereof.

6. The method according to claim 1, wherein the mixture support has an average pore diameter of 50~200 Å, a pore volume of 0.1~1 cc, a specific surface area of 200~400 m$^2$/g and an apparent bulk density of 0.4~1.0 cc/g.

7. The method according to claim 1, wherein the inorganic binder is selected from the group consisting of bentonite, kaoline, clinoptilolite, montmorillonite, γ-alumina, silica, silica-alumina, and combinations thereof.

8. The method according to claim 1, wherein the catalyst is prepared by mixing zeolite, the inorganic binder, platinum and bismuth; and molding the mixture.

9. The method according to claim 1, wherein the catalyst is prepared by mixing zeolite and the inorganic binder, followed by molding the mixture; supporting bismuth onto the molded mixture support; and supporting platinum onto the bismuth-supported mixture support.

10. The method according to claim 1, wherein the catalyst is prepared by mixing zeolite and the inorganic binder; supporting an admixture comprising platinum and bismuth onto the mixture support; and molding the supported mixture support.

11. The method according to claim 1, wherein the catalyst is prepared by supporting platinum onto zeolite; mixing the platinum-supported zeolite and the inorganic binder, followed by molding the mixture; and supporting bismuth onto the platinum-supported mixture support.

12. The method according to claim 1, wherein the catalyst is prepared by mixing zeolite and the inorganic binder, followed by molding the mixture support, while supporting either platinum or bismuth onto the mixture support; and supporting the other metal, which is not supported in a previous step, onto the mixture support.

13. A method of preparing aromatic hydrocarbons and LPG from a hydrocarbon mixture, comprising the following steps of:

(a) introducing a hydrocarbon feedstock mixture and hydrogen into at least one reaction zone;

(b) converting the hydrocarbon feedstock mixture in the presence of a catalyst to (i) a non-aromatic hydrocarbon compound which is abundant in LPG through hydrocracking and to (ii) an aromatic hydrocarbon compound which is abundant in BTX through dealkylation/transalkylation within the reaction zone;

(c) separating the reaction products of step (b) into an overhead stream including hydrogen, methane, ethane and LPG and a bottom stream including the aromatic hydrocarbon compound, and residual hydrogen and non-aromatic hydrocarbon compound, through gas-liquid separation;

(d) recovering the LPG from the overhead stream; and (e) recovering the aromatic hydrocarbon compound from the bottom stream, wherein the catalyst is prepared by supporting 0.01~0.5 parts by weight of platinum (Pt) and 0.01~3.0 parts by weight of bismuth (Bi) onto 100 parts by weight of a mixture support, the mixture support comprising 10~95 wt % of zeolite having a molar ratio of silica/alumina of 200 or less, selected from the group consisting of mordenite, β-zeolite, ZSM-5 zeolite and combinations thereof, and 5~90 wt % of an inorganic binder.

14. The method according to claim 13, further comprising separating the aromatic hydrocarbon compound recovered in step (e) into benzene, toluene, xylene and C9+ aromatic compounds, respectively.

15. A method of preparing aromatic hydrocarbons and LPG from a hydrocarbon mixture, comprising the following steps of:

(a) introducing the hydrocarbon feedstock mixture and hydrogen into at least one reaction zone;

(b) converting the hydrocarbon feedstock mixture in the presence of a catalyst to (i) a non-aromatic hydrocarbon compound which is abundant in LPG through hydrocracking and to (ii) an aromatic hydrocarbon compound which is abundant in BTX through dealkylation/transalkylation within the reaction zone;

(c) separating the reaction products of step (b) into a first overhead stream including hydrogen, methane, ethane and LPG and a first bottom stream including the aromatic hydrocarbon compound, and residual hydrogen and non-aromatic hydrocarbon compound, through gas-liquid separation;

(d) recovering the LPG from the first overhead stream; and (e) separating the first bottom stream into (i) a second overhead stream including the residual hydrogen and the non-aromatic hydrocarbon compound and (ii) a second bottom stream including the aromatic hydrocarbon compound, through distillation; and (f) recovering the LPG from the second overhead stream and recovering the aromatic hydrocarbon compound from the second bottom stream, wherein the catalyst is prepared by supporting 0.01~0.5 parts by weight of platinum (Pt) and 0.01~3.0 parts by weight of bismuth (Bi) onto 100 parts by weight of a mixture support, the mixture support comprising 10~95 wt % of zeolite having a molar ratio of silica/alumina of 200 or less, selected from the group consisting of mordenite, β-zeolite, ZSM-5 zeolite and combinations thereof, and 5~90 wt % of an inorganic binder.

16. The method according to claim 15, further comprising separating the aromatic hydrocarbon compound recovered in step (f) into benzene, toluene, xylene and C9+ aromatic compounds, respectively.

* * * * *